United States Patent [19]

Knight

[11] 4,089,666

[45] May 16, 1978

[54] METHOD FOR CONTROL OF AIR RELATIVE HUMIDITY WITH REDUCED ENERGY USAGE

[75] Inventor: Jack B. Knight, Richmond, Va.

[73] Assignee: Philip Morris Incorporated, Richmond, Va.

[21] Appl. No.: 699,880

[22] Filed: Jun. 25, 1976

[51] Int. Cl.[2] ..... F25D 17/06

[52] U.S. Cl. ..... 62/91

[58] Field of Search ..... 62/91; 165/21; 236/44 C

[56] References Cited

U.S. PATENT DOCUMENTS

| | | | |
|---|---|---|---|
| Re. 20,944 | 12/1938 | Baker | 62/91 |
| 1,944,146 | 1/1934 | Howry | 62/91 |
| 1,986,529 | 1/1935 | Ray | 62/91 |
| 2,075,036 | 3/1937 | Hollis | 62/91 |
| 2,149,990 | 3/1939 | Cook | 62/91 |
| 3,232,029 | 2/1966 | Evans, Jr. | 62/91 |
| 3,247,679 | 4/1966 | Meckler | 62/91 |
| 3,812,685 | 5/1974 | Brown | 62/91 |

*Primary Examiner*—Lloyd L. King

*Attorney, Agent, or Firm*—Watson, Leavenworth, Kelton & Taggart

[57] ABSTRACT

A method for precisely controlling air dry bulb temperature and relative humidity in which the dry bulb temperature is sensed so that variations therefrom produced by cooling of the air in a spray water curtain are used to control the spray water curtain heat exchange area. Additionally, the dew point temperature is sensed and used for controlling the temperature of the spray water and hence the relative humidity in the air at a desired dry bulb temperature.

3 Claims, 3 Drawing Figures

SAT. $H_2O$ 212°F
94.0°F H.W.
214.4°F STEAM
93.1°F HOT WATER
200#/HR TOBACCO
200#/HR TOBACCO
75.8°F DBT
7500 CFM
7500 CFM
62.3°F DPT
74.0°F DBT-AIR
SPRAY WATER TO CURTAIN - 62.1°F
63.7°F SPRAY WATER RETURN
15000 CFM SPENT AIR
78.0°F DBT-SPENT AIR
58.9°F CHILL WATER
46.6°F CHILL WATER
LEGEND
WATER FLOWS
AIR FLOWS
SAMPLE TUBE
ELECTRONIC
PNEUMATIC
PRESSURE TAP

METHOD FOR CONTROL OF AIR RELATIVE HUMIDITY WITH REDUCED ENERGY USAGE

BACKGROUND OF THE INVENTION

Various and numerous industrial processes exist wherein it is desirable and necessary to supply air for a particular processing use at precise conditions of dry bulb temperature and relative humidity. Thus for example, large helical-gear train machining operations frequently are carried out under precisely controlled ambient air conditions respecting both temperature and humidity. Similarly, reordering or moistening of relatively dry tobacco is effected with an air flow which is conditioned with exactitude respecting the temperature and humidity of air passed through the tobacco.

The precision required in such industrial applications particularly as pertaining to relative humidity control in an air stream flow has led to development of relatively high energy consuming air processing techniques to attain that precision. In other words, in order to condition air or reestablish particular parameters of dry bulb temperature and relative humidity in spent air involves energy expenditures for cooling and reheating which are far greater than the actual heat exchange or enthalpy change required to produce change of such parameters from a first spent condition to a second desired condition. Thus, e.g., known processing utilizes low velocity spray washer systems to cool and saturate air at a desired dew point temperature (DPT) to attain the required relative humidity at the desired dry bulb temperature followed by reheating of the air sensibly to the requisite dry bulb temperature. Both of these process steps use unnecessary energy and are only desirable and accepted because of the ease of measuring the temperatures accurately.

In a typical factory air conditioning system, by way of example, spent air, i.e., air that has been subjected to a particular use is returned to an air conditioning unit from a space such that there is an air change every 5 minutes, air handling being at the rate of 25,000 CFM. The return or spent air has gained sensible heat from electric motors, fans, radiation from walls and hot surfaces, and also latent heat and moisture from evaporation of body perspiration and process leaks to such an extent that the air is, e.g., at 77° F dry bulb temperature (DBT) and substantially 59% RH. With reference to a psychrometric chart, it will be noted that such spent air has:

Specific Volume — 13.75 ft.$^3$/lb. of d.a.
DPT — 61.5° F
Enthalpy — 31.4 Btu/lb of d.a.

If it is desired to return the air to the room at designed control conditions of, e.g., 75° F and 60% RH it will be seen from the psychrometric chart that such air would have:

Specific Volume — 13.7 ft.$^3$/lb of d.a.
DPT — 60.1° F
Enthalpy — 30.2 Btu/lb of d.a.

From the foregoing data it will be noted that to reestablish the desired dry bulb temperature and relative humidity values in the air involves a minimum required heat exchange of 1.2Btu/lb of dry air to reduce the enthalpy to the desired level. However, measurement of enthaply can only be accomplished under strict laboratory conditions and, heretofore, continuous accurate measurement for control purposes of any condition other than dry bulb temperature has been difficult in attainment. For such purpose, resistance temperature detectors (RTD's) made of platinum have been developed to measure temperatures within 0.15° F with a repeatability of 0.5° F. Since a small percentage error in measurement of the dew point can cause a large change in relative humidity at a given dry bulb temperature, indirect means have been employed to insure correct measurement of the dew point.

Since it is relatively simple to measure the dry bulb temperature of air accurately and also the temperature of water using RTD's it heretofore has been common practice to reestablish desired conditions in the air by passing it through a washing operation wherein it is subjected to a plurality of sprays spraying water at a desired dew point temperature to effect heat exchange, e.g., remove heat from the air, and since the air leaving the washer has a DBT equal to the temperature of the water entering and leaving the last spray, the air is saturated (100% RH) at that DPT. Referring again to a psychrometric chart shows the enthalpy of saturated air at the desired DPT is 26.5 Btu/lb of d.a.

Thus it will be noted the prior art processing has removed 3.7 more Btu/lb than was required to attain the desired conditions and further the air must now be heated to resupply lost enthalpy and restore the air to desired relative humidity and DBT sensibly. This results in total excess of energy use equivalent to 7.4 Btu/lb of dry air in addition to the 1.2 Btu/lb enthalpy reduction required to bring the spent air to the desired conditions.

On the basis of 25,000 CFM flow for example at 13.7ft$^3$/lb of d.a. or 109,489 lb of d.a. per hour, the required air conditioning load, i.e., the enthalpy differential of dry air at the spent and desired conditions is 131,386 Btu/hr. and the energy wasted by prior art processing is 810,219 Btu/hr. or a wastage of about 86%.

It is seen that prior art processing or conditioning of air to provide desired dry bulb temperature and relative humidity conditions is wasteful of energy. In view of the current energy crisis it is important that processing of air for the purposes described above be effected in such manner as makes possible avoidance of wasteful and unnecessary usage of energy as has heretofore been experienced.

As has been discussed earlier the requirements for conditioning air with exactitude are numerous and hence the potential for energy savings in such processing is of major importance. Illustrative of one such requirement is in the tobacco industry, wherein the control of the moisture content of the air in cut filler storage operation and the cigarette making and packing operations has been shown to be of considerable importance. It is known that tobacco, a natural product, will gain moisture in the presence of high humidity air and lose moisture in the presence of low humidity, and that tobacco of a given grade and crop year will reach the same equilibrium moisture content when exposed to the same RH and DBT air for a suitable period of time and will remain at that moisture as long as the air conditions are maintained constant, a blend of tobacco behaving in this respect in the same manner as individual tobacco grades.

In the cigarette making process shredded tobacco is brought to an ideal or desired moisture content for making and packaging cigarettes. It is important to maintain that desired moisture content throughout the remainder of the processing to prevent breakage, flavor changes, adhering to equipment, and also to ensure final uniform quality of the packaged cigarette. To attain this end the storage, conveying, making, and packaging areas must be maintained at a constant equilibrium RH and DBT to maintain the desired moisture content.

It also is known that reordering (moistening) expanded tobacco can be accomplished by passing a moving bed of relatively dry expanded tobacco through a chamber where carefully controlled humidity air is passed through the bed to raise the moisture content of the tobacco to the proper level for storage, handling, blending, and cigarette making with minimal loss of filling power. The rate of moisture addition at certain moisture levels can affect the filling power of the expanded tobacco. For such purposes, the tobacco could be exposed to its ideal equilibrium moisture humidity air for a day or two to effect the slowest moisture transfer to the tobacco and thus little or no loss of filling power.

Practically, for commercially feasible production requirements it is desirable to accomplish the reordering in a short time such as 30 minutes, which is an attainable goal since it is known that the majority of the moisture to be added to the tobacco can be done fairly rapidly by subjecting the tobacco to a higher RH air up to a certain tobacco moisture and then treating the tobacco with a lower humidity air to add the last few percent moisture. In reordering or moistening relatively dry tobacco it will be understood that the end aim or purpose is to increase the moisture content to that requisite for optimized commercial handling of tobacco as noted above. As used herein "relatively dry tobacco" is meant tobacco containing moisture at a level substantially below that required for processing thereof. In the case of expanded tobacco the desired moisture content should be about 11% but as an incident of expansion the moisture content will have been lowered to about 2%. Cut natural blend or otherwise unprocessed tobacco on the other hand should have a processing moisture content of about 13½%.

SUMMARY OF THE PRESENT INVENTION

The present invention is concerned with a method for reestablishing desired predetermined dry bulb temperature and relative humidity values in a spent air conditioning flow stream which has been subjected to a use resulting in addition of or removal of sensible and/or latent heat to said flow stream. In other words, conditioned air having desired first dry bulb temperature and relative humidity values in becoming spent in a particular use resulting in raising or lowering (by drying) its temperature, and altering its relative humidity from the said first value thereof to a second value is subjected to a treatment which reestablishes the first desired values of DBT and RH. The invention is characterized by the achievement of reestablished dry bulb temperature and relative humidity in the air in a manner involving less usage of energy both in respect of cooling and any reheat operation as may be involved than is possible when following known methods used for the same purpose. In particular the invention proceeds on the basis of exercising exacting measurement of processing condition parameters and minimizing the utilization of heat exchange media, e.g., cooling water and steam to produce the required temperature and humidity changes. The invention is particularly applicable and advantageous of use in respect of moistening relatively dry tobacco with attendant energy saving but while being described herein in representative embodiment as used to that purpose should be understood as being applicable to the broadest possible ranges of usage in handling an air conditioning flow stream so as to effect substantial energy savings.

In accordance with the present invention, spent air which has had its dry bulb temperature and relative humidity altered from desired predetermined values as existed when such air was delivered to a point of use, is treated following use to reestablish the said desired predetermined values therein by passing the spent air through a spray curtain of water for effecting heat exchange with the air, the water spray curtain being maintained at a predetermined temperature relative to the dew point temperature of the spent air. It will be understood that heat exchange can mean either the addition to or removal of sensible or latent heat or both, in the spent air during its heat exchange contact with the spray curtain. Further, "predetermined temperature relative to dew point temperature" is intended to mean such spray curtain temperature as will not effect such heat exchange with the air as will leave the air saturated at the desired dew point temperature. The spray curtain is preferably provided and established by a water spray from a plurality of spray nozzles formed of pairs of opposed nozzles, the discharge of which impinge one with the other to generate a finely misted spray in the shape of a thin film of circular configuration extending transversely of the direction of air flow and presenting an area of heat exchange confronting the air flow. The spray curtain functions as a heat exchange surface with the air contacting the same for heat exchange therewith. Unlike prior art methods, the entire mass or flow of air is not treated by the spray curtain and spray water is supplied to the curtain at the temperature required to obtain the requisite or desired dew point or absolute humidity and at a volumetric rate necessary to attain the desired DBT of the air leaving the spray curtain operation. In effect, the actual heat exchange or change of enthalpy in the air between entering and leaving the spray operation is considerably less than that heretofore practiced and hence, a considerable margin of energy savings is obtained, such heat exchange being substantially only that as represents the difference between the enthalpy of the air at spent conditions and that at the desired reestablished conditions.

For reestablishing the desired dry bulb temperature and relative humidity values concomitant with energy savings, accurate sensing of DBT and DPT in the treated air is maintained. The dry bulb temperature of the air is measured downstream of the spray curtain, e.g., immediately upon leaving the spray curtain, and responsive to variations in such DBT from the desired predetermined value the spray curtain area is varied to correspondingly control the quantity of heat exchange effected to the air. Most conveniently, this is done by varying the volume of water supplied to the spray curtain. Unlike prior systems employing spray nozzle arrangements which are particularly susceptible to erratic spray generation over a range of pressures, the present invention employs a modulating spray configuration using opposed nozzles operating from a common supply header, which nozzles exhibit generally straight line spray area variations responsive to changes in the volumetric flow therethrough. In this manner, the spray area of the curtain readily and precisely can be controlled by controlling the volume and thus the pressure of the water supplied to the header and responsive to the sensed dry bulb temperature.

It also is important to accurately sense the DPT of the air leaving the spray curtain and responsive to variations of such sensed DPT from a predetermined value, controlling the temperature of the water supplied to the spray curtain. Again, such measurement is effected to a degree of precision heretofore not practiced in the art. Devices suited to that purpose include 1200 Series Optical Dew Point Hygrometers as manufactured by General Eastern Corporation of Watertown, Mass. and Model 440 Dew Point Hygrometers of EG&G — Environment Equipment Division, Waltham, Mass.

To optimize equilibration of desired dry bulb temperature and relative humidity throughout the air stream being treated and particularly since not all the air passing through the spray curtain zone actually contacts the spray water, the air stream immediately downstream of the spray curtain, and before the location at which DBT and DPT are sensed is subjected to a mixing operation, for example, by directing the air through a mixing baffle of known construction.

The invention further provides that the spray water supplied to the spray curtain operation be maintained at prescribed temperature by passing it in direct heat exchange relationship with a chilled water flow or in indirect relationship with chilled water, brine or like coolant fluid, the utilization of indirect heat exchange being particularly desirable in utilization of the present invention for moistening relatively dry tobacco as to be described next.

In using the present invention in reordering or moistening relatively dry tobacco, a continuous flow of spent air is subjected to heat exchange in the water spray curtain in the manner described above and after pasing therethrough and being subjected to a mixing operation is split into a first portion and a remainder or second portion, the portions being of substantially equal volumes. The first portion at prescribed DBT and relative humidity values is then passed through a moving bed of relatively dry tobacco, e.g., tobacco with a moisture content of about 2% at a rate such as to raise the moisture content of the tobacco from said 2% level to about 8.5%. The tobacco is thereafter passed to a second moving bed thereof wherein the remainder portion of the treated air is passed through the tobacco to raise its moisture content to about 11%. However, prior to passing the remainder portion of air through the tobacco, said remainder portion of air desirably is heated to reduce its relative humidity to a slightly lower level than that present in the first portion of air. This is done since as indicated earlier, the majority of moisture (e.g. about 6.5%) can be relatively rapidly transferred to the tobacco with somewhat higher RH air, whereas, the remaining moisture (e.g. about 2.5%) should be added at a somewhat slower rate with lower RH air so as to avoid diminishing the filling capacity of the tobacco.

Generally, the tobacco moistening times involved with both portions of treated air will be substantially equal, e.g., about 15 minutes each and the moving bed speed controlled accordingly.

By employing the present invention in respect of reordering tobacco very significant energy savings in both cooling and heating loads can be realized to the extent of reducing same to a level of 25% or less than those involved in heretofore conventional methods.

A particularly preferred manner of reordering relatively dry tobacco involves use of two separate streams of air for treatment of the tobacco in which case, the respective first and second streams are conditioned separately in separate spray curtains to provide each with desired predetermined dry bulb temperature and relative humidity values, the relative humidity value of said first stream being higher than that of said second stream. The first air stream is passed through the tobacco in a first treatment zone to raise the moisture content thereof a certain level. The tobacco is then conveyed to a second separate treatment zone wherein the second air stream is passed therethrough to add additional moisture to the tobacco. The advantage of using separate streams is that it eliminates the need for a reheating operation.

The invention accordingly comprises the several steps and the relation of one or more of such steps with respect to each of the others all as exemplified in the following detailed description and the scope of the invention will be indicated in the claims.

BRIEF DESCRIPTION OF THE DRAWINGS

Other objects of the invention will be in part obvious and will in part appear from the following detailed description taken in conjunction with the accompanying drawings wherein like reference numerals identify like parts throughout and in which.

DESCRIPTION OF THE PREFERRED EMBODIMENTS

The present invention is applicable to conditioning air generally to reestablish certain desired parameters in a spent air conditioning system air stream in a manner as involves realizing substantial energy savings as an adjunct of the parameter reestablishment procedure. It will be appreciated that the energy savings will result not only from the consequence of reduction or elimination of usage of reheat medium but all of the energy consumption facets of operation ancillary to overall air treatment cycle, e.g., pumping requirements. Thus the present invention is of salutary significance in respect of energy savings whether the incidence of such savings be reflected by lessened requirement for usage of electric power, fuel or whatever energy source may be involved in carrying out air conditioning. Because of the broad importance of the present invention, the description thereof which follows and is given with respect to moistening of relatively dry tobacco should be interpreted as being illustrative only of the principles of the invention and not taken as being limitative of the scope thereof.

Figure 1:
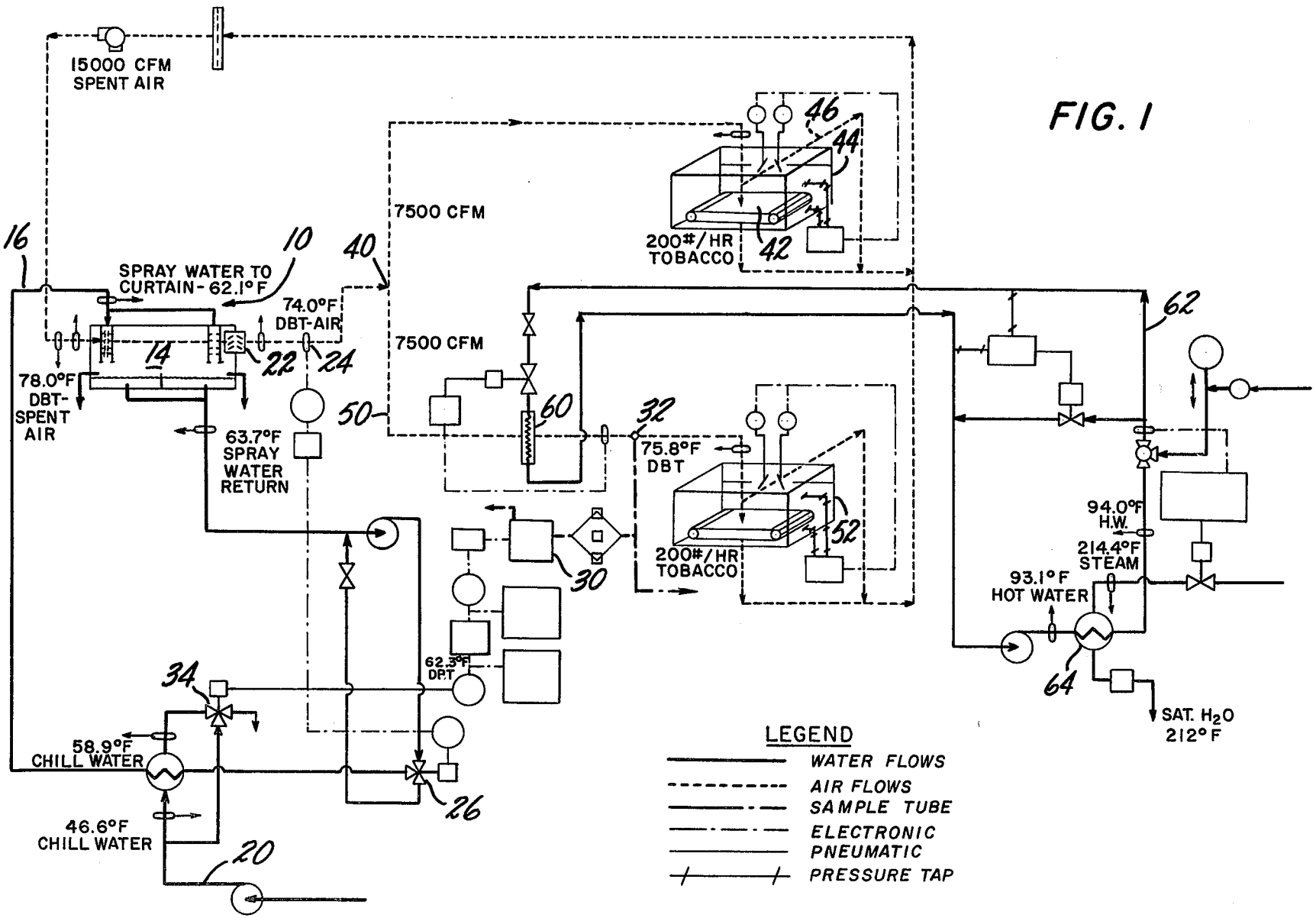
FIG. 1 depicts a system for processing air in accordance with the principles of the present invention, the processed air being employed or spent in moistening relatively dry tobacco, the air being used in two separate portions thereof to effect separate moisture transfer of respective lower and higher moisture contents to the tobacco, the system employing a closed circuit chilled water flow in which the chilled water used to control spray water temperature passes in indirect heat exchange with the spray water.

Referring now to FIG. 1 of the drawings, there is depicted an air washer unit 10 of known construction which includes a housing 12 defining a chamber 14 in which is disposed a number, e.g., two banks of spray water nozzles and through which spent air returned, for example, from a tobacco moistening operation wherein latent and/or sensible heat has been added thereto or removed therefrom, it being the purpose of reestablishing predetermined dry bulb temperature and relative humidity values in the spent air by effecting heat exchange to the air in unit 10. The nozzle units provided for the depicted system are arranged in opposed pairs of nozzles supplied from a common header, the discharge of which impinge each other to produce a generally circular configured spray defining a spray area of variable area. The nozzles in the depicted unit are an opposed nozzle spray generation system as manufactured by Enviortech Bahnson, Industrial Air Quality Division of Winston-Salem, N.C. and are characterized by producing a spray pattern the size of which varies in substantially straight line according to the volumetric flow therethrough (e.g. from about 3 to 30 inches in diameter). Thus by varying the volume of water supplied to the nozzle units, the heat exchange area presented thereby to the air flow can be varied to control the amount of heat exchange with the air. In the particular unit 10 shown, there are a total of 24 nozzle units arranged 4 wide and 3 high in each bank, the air flow course through unit 10 being 7 feet wide by 51 inches high. Spray water for heat exchange purposes is supplied through line 16 to the nozzle units and the spray water is maintained at a predetermined temperature relative to the dew point temperature of the spent air (e.g., and where latent heat must be removed from the air, a temperature above the DPT of the spent air) by passing it in indirect heat exchange relationship with chilled water in a heat exchanger 18, the chilled water being supplied through line 20, the spray water thus flowing in a closed circuit. Following passage of the air through the water spray curtain in chamber 14, the same is passed through a mixing unit 22, e.g., a normal velocity water droplet elininator of known construction to equilibrate the DBT and relative humidity thereof since as will be appreciated, not all of the air passing through the spray curtain actually contacts the spray water.

In accordance with the present invention, heat exchange or enthalpy removed from or added to the spent air in chamber 14 is minimized as closely as possible to that theoretically required to respond to the entrance and exit DBT and relative humidity parameters of the air. In such manner substantial energy savings are to be realized by precision control of the volume and temperature of the spray water supplied to chamber 14. To effectuate such purpose, the DBT of the air leaving chamber 14 is sensed as at 24 and is utilized to vary the volume of spray water flowing through line 16, correspondingly varying the spray area in accordance with variation of the DBT from the desired predetermined value. Thus if the DBT of the air leaving the chamber 14 is above the desired value, the sensed value is employed to close down spray water by-pass at value unit 26 and send a greater volume of spray water to chamber 14 enlarging the spray curtain area. Conversely a DBT which is below the desired value results in greater by-pass of spray water at valve 26 diminishing the spray curtain area with consequent less removal of heat from the air. In like fashion and with like precision, the DPT of the air is sensed as at 30 from tap 32 in the downstream air flow. Departures of such DPT from the desired predetermined value results in greater or less by-pass of chilled water at valve unit 34 to send greater or lesser quantities of chilled water to heat exchanger 18 providing commensurate lessening and increasing of the temperature of the spray water and by such procedure controlling the DPT and hence the RH of the air leaving the spray curtain at the desired value thereof.

Following treatment of the air in chamber 14, it is split off into 2 portions as at 40, and a first portion is passed through conduit 41 to relatively dry tobacco moving on conveyor 42 in reorder unit 44, the air flow to unit 44 being in part by-passed as at 46 to maintain a fixed pressure differential across (and consequently, a uniform flow rate through) the moving tobacco bed. In moistening tobacco in unit 44, the moisture content is, e.g., raised from about 2% to about 8.5L % over a period of about 15 minutes, the relative humidity of the air being by way of illustration about 60% to 62%, the other system temperature and humidity parameters depicted being those applicable to this particular tobacco processing. Based on a particular circumstance, other parameters of time, RH and moisture content could be employed in treating tobacco in accordance with the principles of the present invention. The remainder air portion flowing through conduit 50 is employed to add the remaining required moisture to the tobacco. However, since the final levels of moisture should be added to the tobacco at a somewhat lower rate than obtained in unit 44, the air passing to reorder unit 52 is subjected to a heating thereof to lower its relative humidity, e.g. to about 58% by passing it through reheater unit 60, such unit receiving a flow of heated water from source conduit 62 which water in turn is heated by indirect exchange with steam flowing to heat exchanger 64, various controls being provided for the heating operation as depicted.

Illustrative of the degree of energy savings possible in accordance with the present invention in reordering expanded tobacco can be seen from Table I following which lists the respective refrigeration or cooling loads and reheat loads involved in treating the tobacco in a reordering system using prior art methodology for controlling DBT and relative humidity and after such system was modified to operation according to the present invention. Reduction of energy usage to as little as 25% of that heretofore used is achieved.

TABLE I

| Run No. | Tobacco Moisture % In | Tobacco Moisture % Out | Tob. Flow lb/hr | Refrig. Load MBtu/hr | Heat Load MBtu/hr | Filling Power, cc/10gm In | Filling Power, cc/10gm Out | |
|---|---|---|---|---|---|---|---|---|
| 1 | — | — | 200 | 153.78 | 176.13 | — | — | Before Modification |
| 2 | — | — | 200 | 188.11 | 166.49 | — | — | |
| 3 | — | — | 200 | 169.29 | 167.43 | — | — | |
| Avg. | 1.5 | 11.0 | 200 | 170.39 | 170.02 | 69.0 | 66.3 | |
| No. load | — | — | — | 170.79 | 191.03 | — | — | |
| 1 | — | — | 200 | 97.57 | 12.69 | — | — | After Modification |
| 2 | 1.5 | 11.2 | 200 | 86.60 | 15.75 | 73.8 | 73.5 | |
| 3 | 1.5 | 11.4 | 200 | 65.70 | 10.91 | 69.2 | 67.5 | |
| Avg. | 1.5 | 11.3 | — | 83.29 | 13.12 | 71.5 | 70.5 | |

TABLE I-continued

| Run No. | Tobacco Moisture % In | Tobacco Moisture % Out | Tob. Flow lb/hr | Refrig. Load MBtu/hr | Heat Load MBtu/hr | Filling Power, cc/10gm In | Filling Power, cc/10gm Out |
|---|---|---|---|---|---|---|---|
| No load | — | — | — | 87.80 | 8.55 | — | — |
| Avg. Red. | — | — | | 87.50 | 159.9 | — | — |

Figure 2:
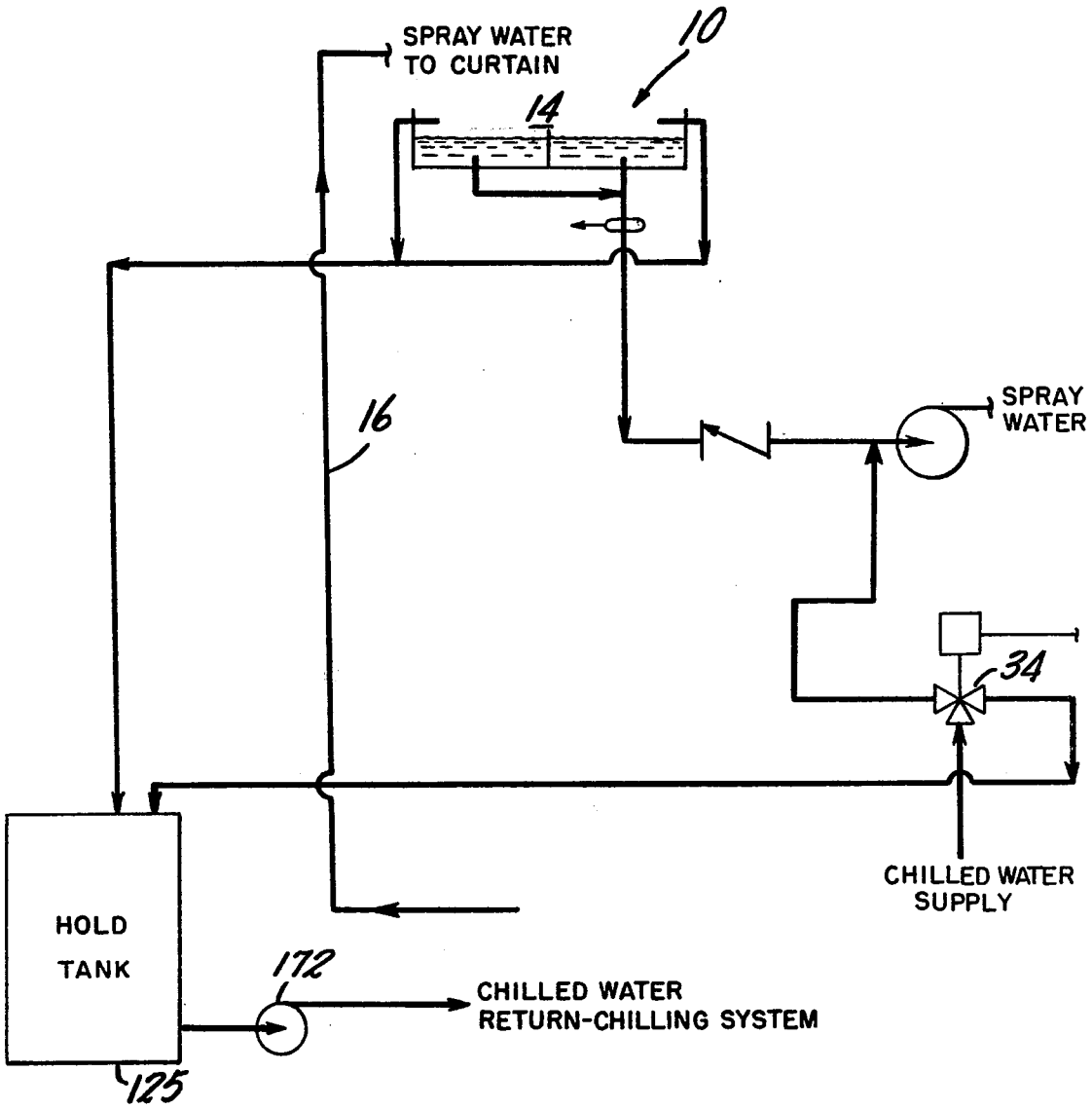
FIG. 2 is a fragmentary portion of an alternative system in which the chilled water is mixed directly with the spray water to control the temperature of the latter.

FIG. 2 shows a modified system in which corresponding reference numerals show corresponding parts of this system as discussed in FIG. 1. The FIG. 1 system as will be noted involves flow of a spray water in a closed circuit having an indirect heat exchange with the chilled water. For many uses of the invention, the arrangement of FIG. 2 is quite suitable. Moreover, a direct spray water-chilled water system is a more efficient manner of effecting heat transfer to and from the spray curtain water. However, in the circumstance of using the invention respecting moistening expanded tobacco, it may be desirable to have a closed circuit spray water flow since the air contacting the spray water may contain some residue of expanding agents which were contained in the tobacco. Accordingly, in a closed circuit, there could be a circuit build-up of such impregnating agents which should be separated from the chilled water to prevent contamination of the whole chill-water system. For that purpose, the system shown in FIG. 1 can be employed so that the spray water is recycled only through the basin of chamber 14 wherein such impregnating agents can be removed or maintained at an acceptable level by known water-treating methods. In the application of FIG. 2, the temperature of the spray water is altered by directly adding chilled water thereto at 34. The holding tank 125 serves only as a sump to maintain a fixed supply of water to the chill-water return pump 172.

Figure 3:
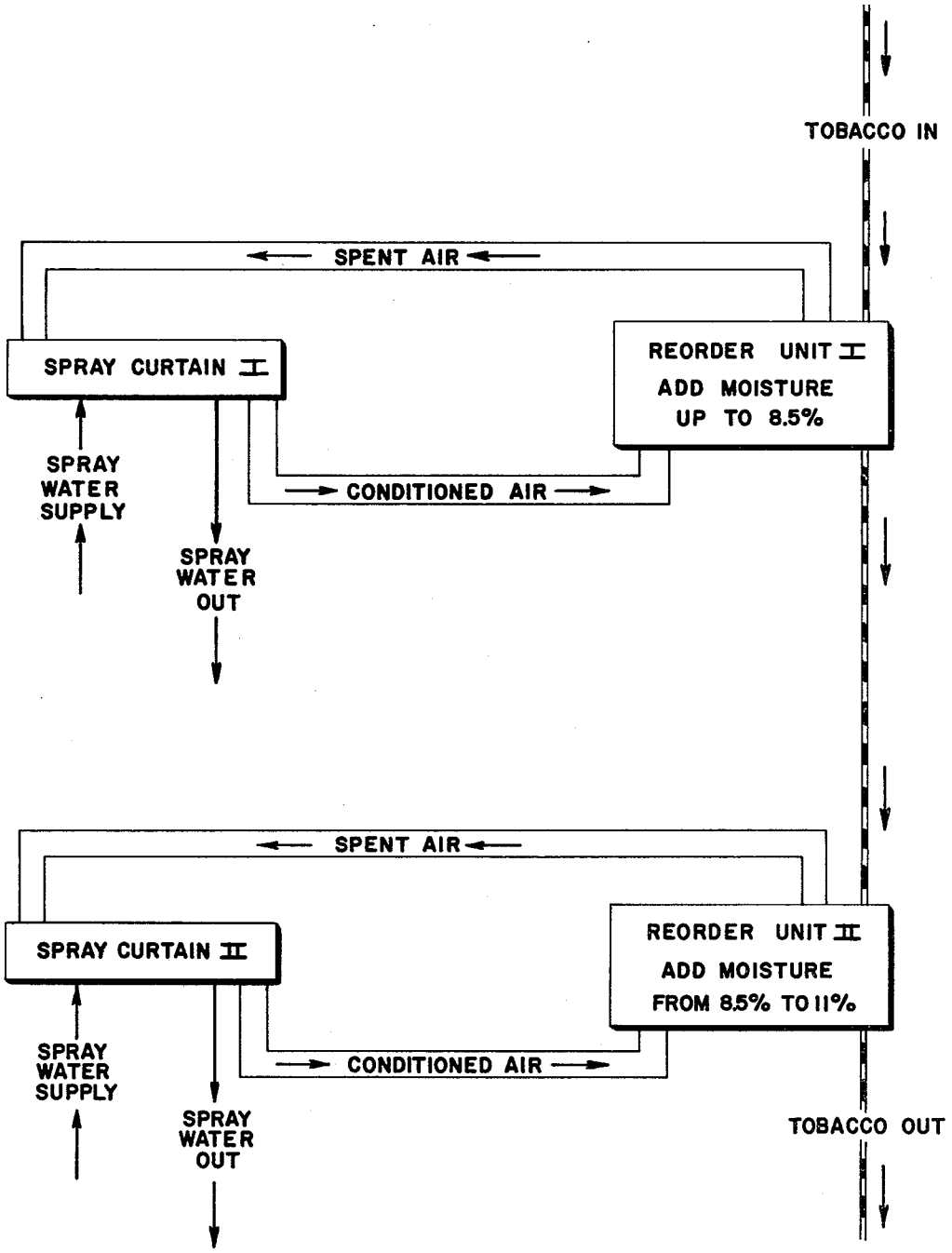
FIG. 3 is a schematic depiction of a system for moistening tobacco in which two separate streams of air are used for transfer of moisture to the tobacco with the respective streams being conditioned in separate spray curtains.

FIG. 3 shows a particularly preferred manner of moistening relatively dry tobacco in accordance with the present invention. In such arrangement, first and second streams of spent air are conditioned in respective first and second water spray curtains to provide them with desired predetermined dry bulb temperature and relative humidity values, with the relative humidity value of the said first stream being higher than that of said second stream. In conditioning these streams, they are passed through the spray curtains for the same purpose and effect as described earlier. The conditioned air stream from the first curtain I is conveyed to a first reorder unit I in the zone of which the tobacco is exposed to said stream to raise the moisture content of the tobacco from about 2% to about 8.5%, with the spent air from the first reorder unit being recycled to the first spray curtain unit. The tobacco which has had moisture added to it in the first reorder unit I is then conveyed to the second reorder unit II wherein the stream of conditioned air from spray curtain unit II is passed throgh the tobacco to increase its moisture content from about 8.5% to about 11%. In similar fashion, the spent air from reorder unit II is recycled or returned to the spray curtain unit II. The particular advantage of such arrangement of processing is the elimination of the need for reheating of the conditioned air for the second reordering operation as is the case with the process descirbed above with respect to FIG. 1 with attendant further energy savings. The parameters applicable to the description of the process in FIG. 1 and related to the two separate streams described therein are equally applicable to the processing conditions associated with FIG. 3.

What is claimed is:

1. A method for reestablishing desired predetermined dry bulb temperature and relative humidity values in a spent air conditioning flow stream which has been subjected to a use resulting in addition or removal of sensible and/or latent heat to said flow stream, which method comprises passing the spent air through a water spray curtain maintained at a predetermined temperature relative to the dew point temperature of the spent air and disposed transversely of the direction of the air flow, said water spray curtain presenting an area of heat exchange confrontation to said flow, sensing the dry bulb temperature of the air downstream of the spray curtain and varying the spray curtain area responsive to variations of the sensed dry bulb temperature from said desired predetermined value thereby to correspondingly control the quantity of heat exchange effected to the air in said spray curtain, sensing the dew point temperature of the air downstream of the spray curtain and controlling the temperature of the water supplied to said spray curtain responsive to variations of the sensed dew point temperature from a predetermined value thereby to control the dew point temperature of the air at said predetermined value whereby the air leaving said spray curtain is at said desired relative humidity value, and returning the thus treated air to a point of use.

2. The method of claim 1 in which the spray curtain area is varied responsive to variations of the sensed dry bulb temperature by varying the volumetric flow rate of water supplied to said spray curtain.

3. The method of claim 1 in which the air flow stream passing from the water spray curtain is subjected to a mixing operation to equilibrate the dry bulb temperature and relative humidity values throughout said stream.

* * * * *